US007444902B1

(12) United States Patent
Lin et al.

(10) Patent No.: US 7,444,902 B1
(45) Date of Patent: Nov. 4, 2008

(54) INTERCHANGEABLY MANUAL OR AUTOMATIC RATCHET WRENCH TOOL

(75) Inventors: Shu-Sui Lin, Taichung (TW); Wan-Chuan Li, No. 1, Alley 49, Lane 23, Yi Chang E. Rd., Tai-Pin City, Taichung (TW)

(73) Assignees: A.A.G. Industrial Co., Ltd., Taichung (TW); Wan-Chuan Li, Taichung (TW)

( * ) Notice: Subject to any disclaimer, the term of this patent is extended or adjusted under 35 U.S.C. 154(b) by 0 days.

(21) Appl. No.: 11/800,139

(22) Filed: May 4, 2007

(51) Int. Cl.
*B25B 13/46* (2006.01)
*B25B 17/00* (2006.01)

(52) U.S. Cl. ..... 81/57.29; 81/58.1; 81/63.1

(58) Field of Classification Search ..... 81/60–63.2, 81/177.2, 57.13, 57.29, 58.1
See application file for complete search history.

(56) References Cited

U.S. PATENT DOCUMENTS 2,808,749 A * 10/1957 Lampke ..... 81/57.13
6,311,584 B1 * 11/2001 Chu ..... 81/57.29
7,069,818 B1 * 7/2006 Huang ..... 81/57.29

* cited by examiner

*Primary Examiner*—Hadi Shakeri
(74) *Attorney, Agent, or Firm*—Pro-Techtor Int'l Services

(57) ABSTRACT

The present invention relates to an interchangeably manual or automatic ratchet wrench that the user may couple an electric hand grip having a motor therein to the rear end of a stud member of a handle so as to urge a cartridge to rotate in an electric operation manner, or couple a manual hand grip to the rear end of the stud member of the handle so as to urge the cartridge to rotate in a manual operation manner, such that achieving a multi-purpose operation.

4 Claims, 19 Drawing Sheets

INTERCHANGEABLY MANUAL OR AUTOMATIC RATCHET WRENCH TOOL

BACKGROUND OF THE INVENTION

1. Field of the Invention

The present invention relates to an interchangeably manual or automatic ratchet wrench that can easily interchange its hand grip so as to have different operational modes.

2. Description of the Prior Arts

Referring to FIGS. 1-3, TW Pat. No. 95140625, to Lin et al., discloses a conventional tang and ratchet wrench with rotating disc operated direction change of drive and ratcheting comprises an enclosed box portion 101 having driving teeth 102 around its interior surface provided in the wrench head integrally formed with a handle 10. A rotatable drive mechanism 11 is provided in the box portion 101. The drive mechanism 11 comprises first and second cavities 112, 113 thereon, a right surface 115 abutted the first cavity 112 and a left surface 116 abutted the second cavity 113, a channel 114 interconnected the first and second cavities 112 and 113, first pawl 14 having pawl teeth 141 and an arcuate groove 142 thereon, second pawl 15 having pawl teeth 151 and an arcuate groove 152 thereon being respectively received in the first and second cavities 112, 113 of the drive mechanism 11, by using two springs 18 and 19 which anchored in two of apertures 119 recessed into a wall of the channel 114, the first and second pawls 14, 15 can be urged to move inwardly or outwardly in the first and second cavities 112, 113, a square drive tang 111 extended downwardly from bottom, a vertical hole 117 extended from a bottom of the channel 114 to a bottom of the tang 111, a spring depressible ball 118 anchored on a side dent of the tang 111, a spring 16 and a detent 17 for being biased against a first or second recess 124 or 125 provided in another aperture 119 which is also recessed into a wall of the channel 114.

A rotating disc 12 comprises a shaft 121 extended downwardly into the channel 114, two pin 122, 123 corresponding to the arcuate grooves 142, 152 fixed beneath the rotating disc 12 for hooking the arcuate grooves 142, 152 to move the first and second pawls 14, 15 outwardly or inwardly in the first and second cavities 112, 113 such that as the first and second pawls 14, 15 are moved outwardly, they abut against the right or left surface 115 or 116 so as to urge the drive mechanism 11, a central hole 126 through the top and the shaft 121, and first and second recesses 124 and 125 respectively provided on one side of the shaft 121. A spring biased push rod 13 is provided in the holes 126 and 117 and comprises a well 131 on its shank. The ball 118 is adapted to retract into the well 131 for disengaging the tang 111 from a workpiece. The push rod 13 is a well known device. Thus, a detailed description thereof is omitted herein for the sake of brevity.

A first pawl 14 is provided in the first cavity 112 and comprises pawl teeth 141 along an outer side, a detent notch on an inner side being urged by the spring 48. A portion of the inner side of the first pawl 14 is abutted the right surface 115 in a non-operating position. The pawl teeth 141 are adapted to releasably engage with the driving teeth 102. Similarly, a second pawl 15 is provided in the first cavity 113 and comprises pawl teeth 151 along an outer side, a detent notch on an inner side being urged by the spring 19. A portion of the inner side of the second pawl 15 is abutted the left surface 116 in a non-operating position. The pawl teeth 151 are adapted to releasably engage with the driving teeth 102.

Referring to FIG. 3 specifically, as loosening the workpiece, the pin 123 of the rotating disc 12 urges the second pawl 15 to move inwardly, but the first pawl 14 is not urged by the pin 122. As rotating the handle 10 anticlockwisely, by using the spring 18, the driving teeth 102 engages with the pawl teeth 141 of the first pawl 14 anticlockwisely, and because the first pawl 14 abuts against the right surface 115 of the first cavity 112, causing the simultaneously anticlockwise rotation of the drive mechanism 11 so as to loosen the workpiece.

Referring to FIG. 4, as rotating the handle 10 clockwise, the driving teeth 102 urges the pawl teeth 141 clockwisely so that the first pawl 14 compress the spring 18 and moves inwardly, and then passes across the pawl teeth 141 of the first pawl 14 such that the handle 10 returns its initial position, thus resulting in a further anticlockwise loosening of the workpiece.

Referring to FIG. 5, after initially loosening the workpiece a user may continuously turn the rotating disc 12 anticlockwise for quickly loosening the workpiece, simultaneously, the pin 123 urges the second pawl 15 to move inwardly, such that the second pawl 15 pushes the drive mechanism 11 to cause an anticlockwise rotation, the pawl teeth 141 of the first pawl 14 is urged to move inwardly by the driving teeth 102 of the handle 10 and they pass across the driving teeth 102 tooth by tooth, thus resulting in a further loosening of the workpiece.

However, such a conventional tang and ratchet wrench with rotating disc operated direction change of drive and ratcheting can not be interchanged to operate in an electric operation mode, thus its operational efficiency is limited.

The present invention has arisen to mitigate and/or obviate the afore-described disadvantages.

SUMMARY OF THE INVENTION

The primary object of the present invention is to provide an interchangeably manual or automatic ratchet wrench tool that the user may couple an electric hand grip having a motor therein to the rear end of a stud member of a handle so as to urge a cartridge to rotate in an electric operation manner, or couple a manual hand grip to the rear end of the stud member of the handle so as to urge the cartridge to rotate in a manual operation manner, thereby achieving a multi-purpose operation.

In accordance with one aspect of the invention, there is provided an interchangeably manual or automatic ratchet wrench tool comprising a handle including a chamber defined in the head end thereof and having an internal gear provided therearound, and including a longitudinal channel arranged therethrough and communicating with the chamber;

a cartridge received in the chamber of the handle and including an actuation bar attached to the bottom thereof, and including two lateral cavities and a longitudinally large-diametered bore all fixed thereon;

two pawls received in the two lateral cavities of the cartridge and biased against by springs respectively, and including a plurality of teeth affixed thereon for engagement with the internal gear of the handle, and including arcuate slots secured therein individually;

a direction controlling member received in the chamber of the handle and including a rotary stem extended from the bottom thereof and fitted in the large-diametered bore, at the predetermined positions of the direction controlling member where are in response to the arcuate slots of the pawls and adjacent to the rotary stem being extendedly mounted two pins respectively, which may be inserted into the arcuate slots, besides, the direction controlling member further including a peripheral gear disposed around the bottom thereof;

a stud member and a shank member both fitted through and in the longitudinal channel of the handle, one end of the stud member having an engaging block for engagement with the peripheral gear of the direction controlling member, and another end thereof extending out of the longitudinal channel of the handle, one end of the shank member having an pinion for engagement with the peripheral gear of the direction controlling member, and another end thereof extending out of the longitudinal channel of the handle as well, wherein an electric hand grip has a motor placed therein and is coupled to the rear end of the handle, and the stud member is fittingly joined to an output spindle of the motor so as to obtain an electric operation, or a hand grip having an adaptor element coupled thereto is fittingly connected to the stud member of the handle, so as to obtain a manual operation.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
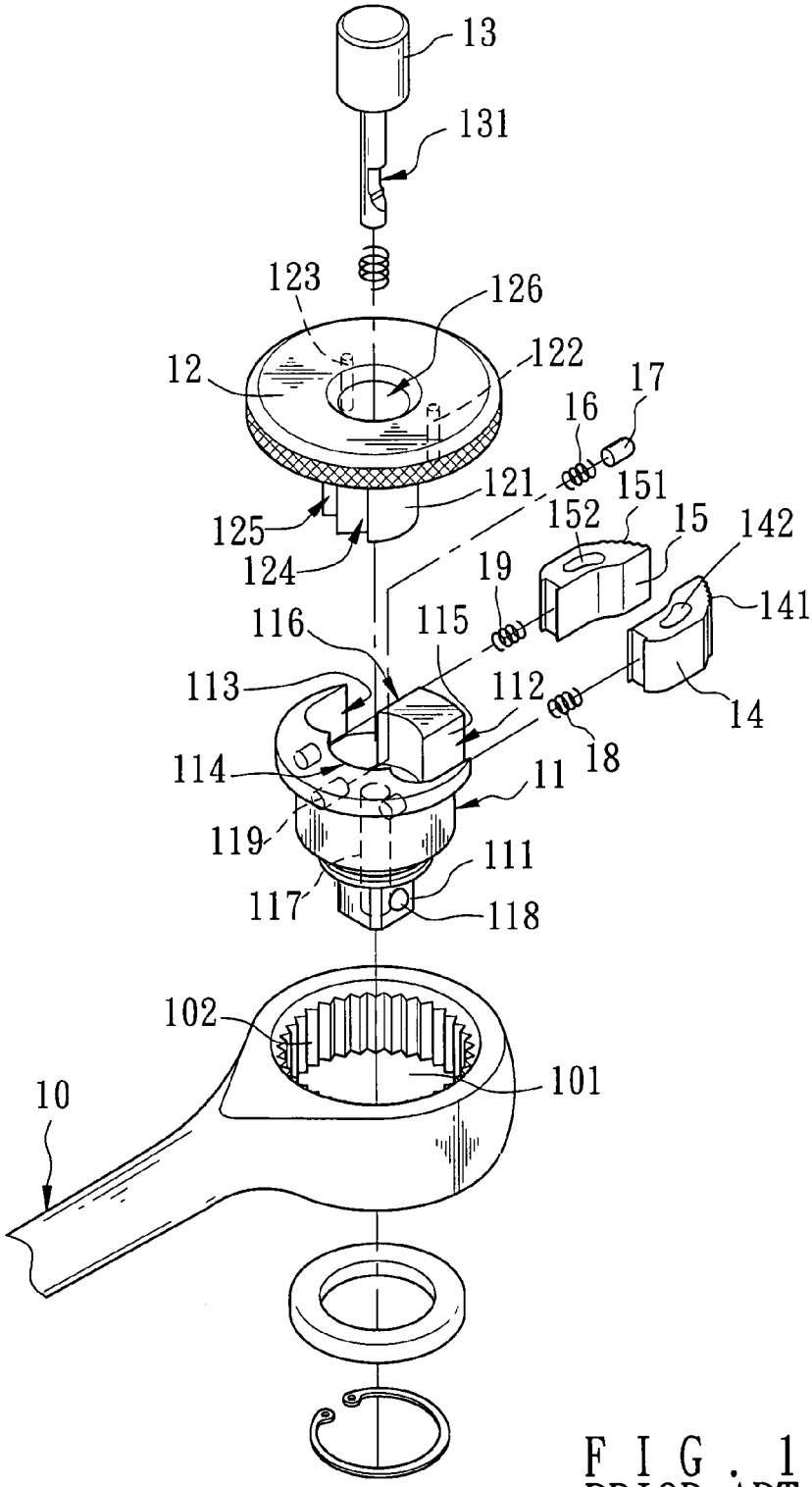
FIG. 1 PRIOR ART
FIG. 1 is an exploded view of a conventional tang and ratchet wrench with rotating disc operated direction change of drive and ratcheting of TW Pat. No. 95140625.
Figure 2:
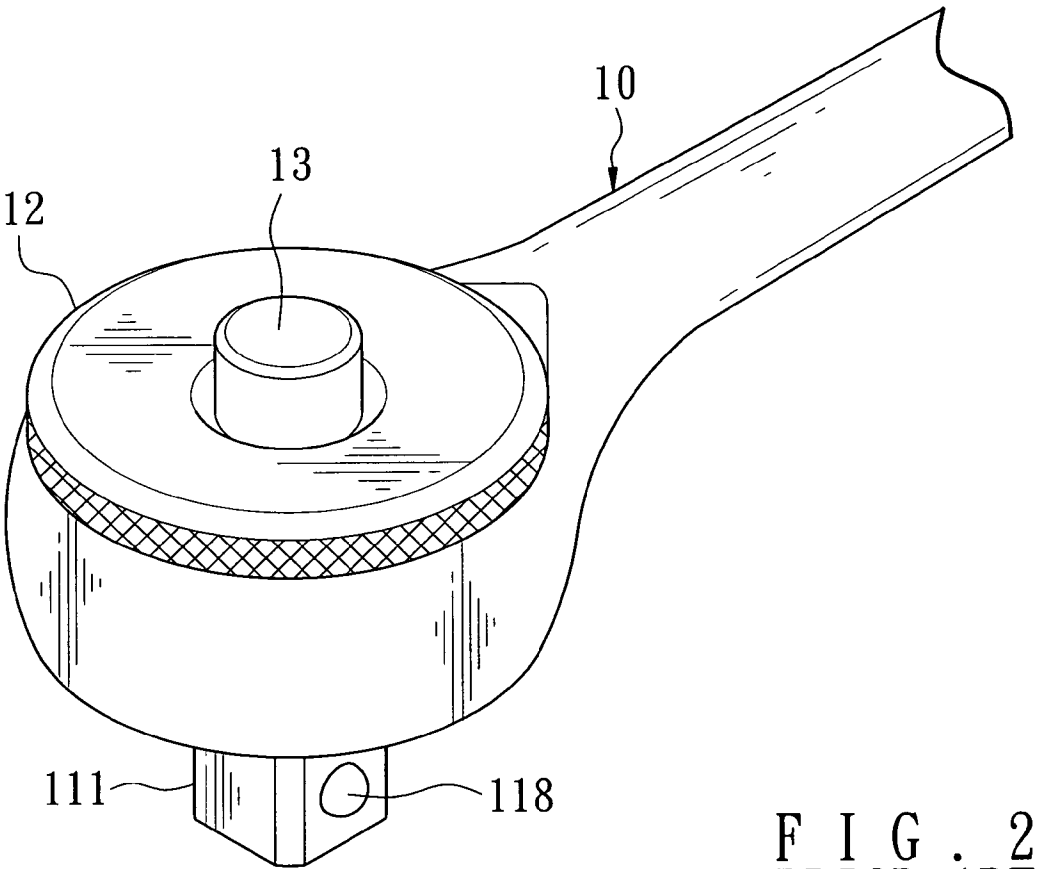
FIG. 2 PRIOR ART
FIG. 2 is a perspective view of the conventional tang and ratchet wrench with rotating disc operated direction change of drive and ratcheting of TW Pat. No. 95140625.
Figure 3:
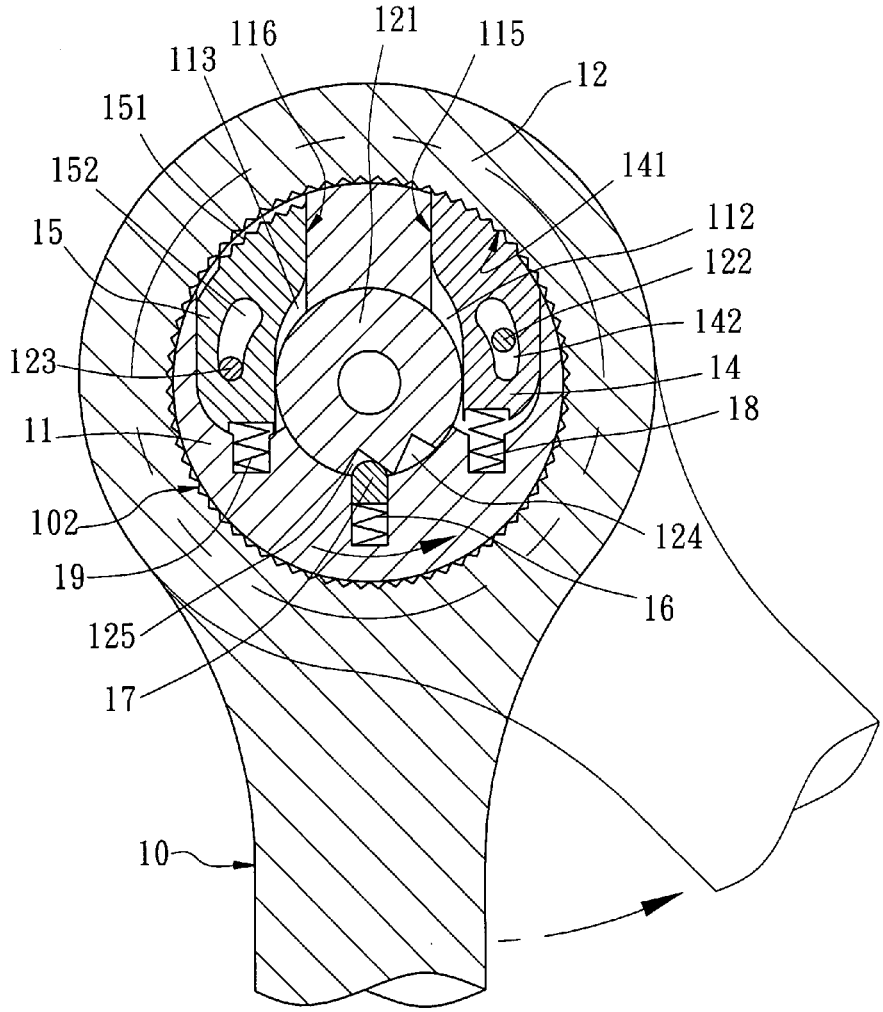
F I G . 3 PRIOR ART
FIG. 3 is an operational view of the conventional tang and ratchet wrench with rotating disc operated direction change of drive and ratcheting of TW Pat. No. 95140625, illustrating a handle being rotated in a counterclockwise direction.
Figure 4:
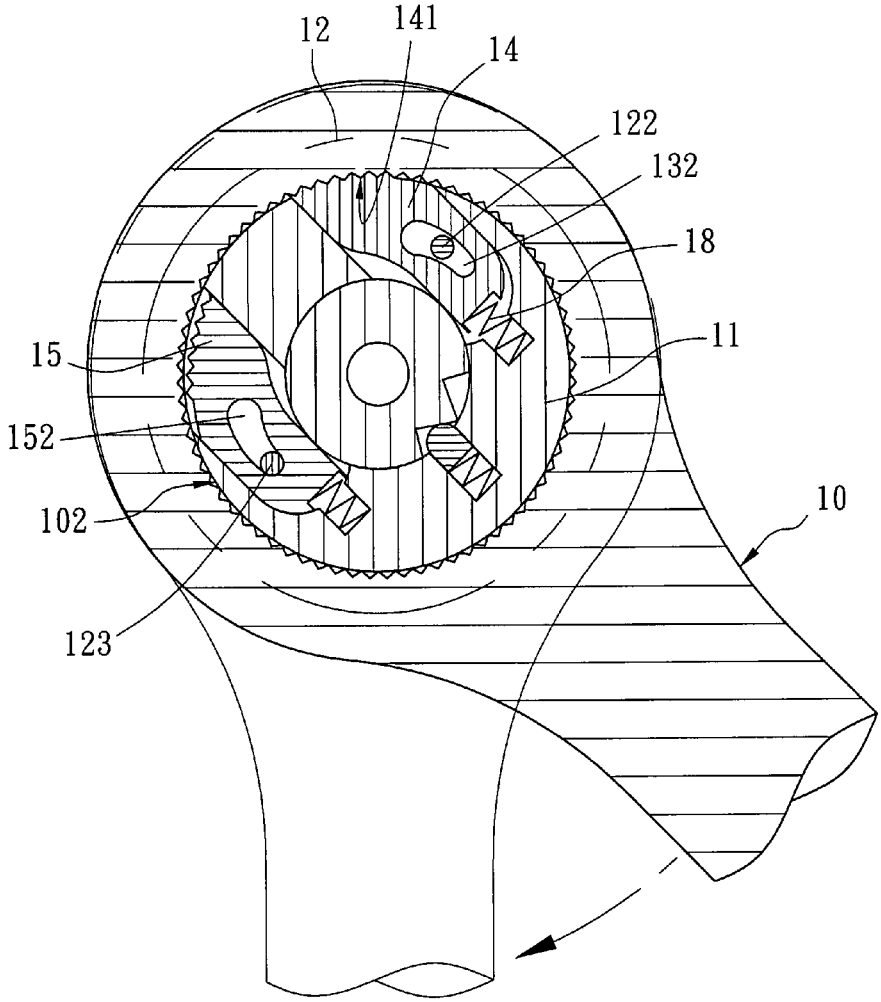
F I G . 4 PRIOR ART
FIG. 4 is an operational view of the conventional tang and ratchet wrench with rotating disc operated direction change of drive and ratcheting of TW Pat. No. 95140625, illustrating the handle being rotated in a clockwise direction.
Figure 5:
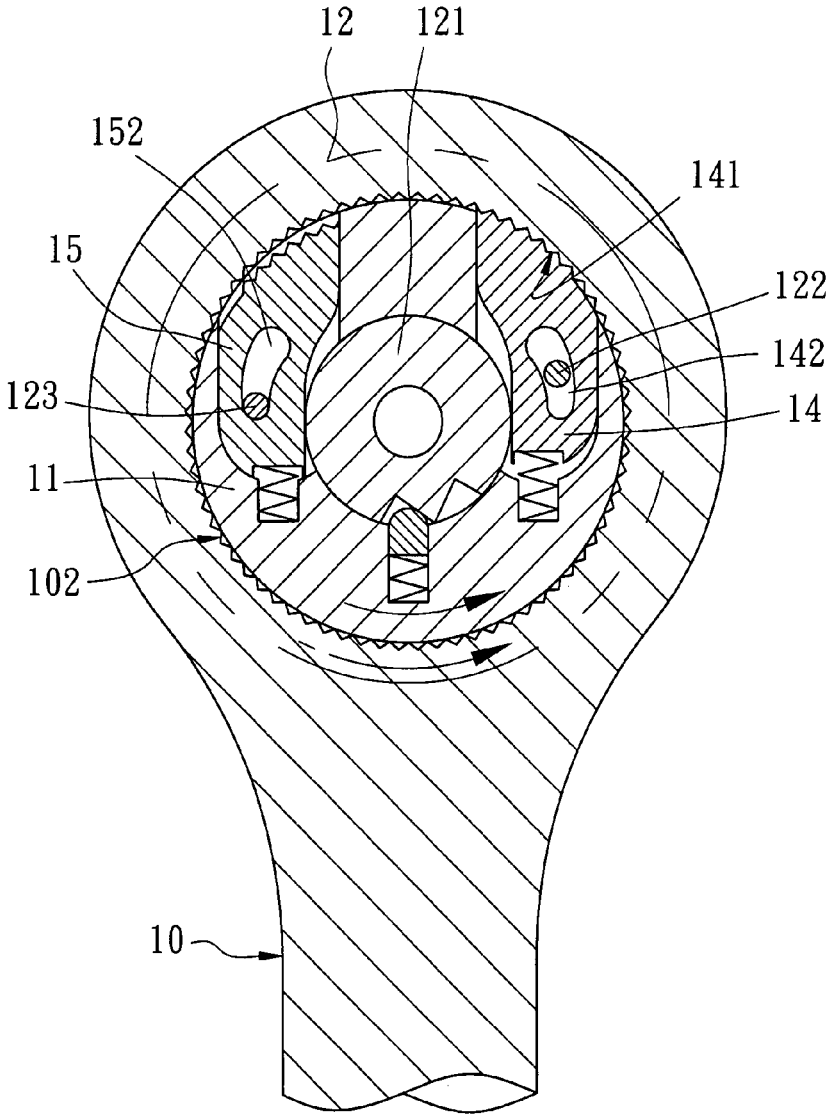
F I G . 5 PRIOR ART
FIG. 5 is an operational view of the conventional tang and ratchet wrench with rotating disc operated direction change of drive and ratcheting of TW Pat. No. 95140625, illustrating a rotating disc being rotated in a clockwise direction.
Figure 6:
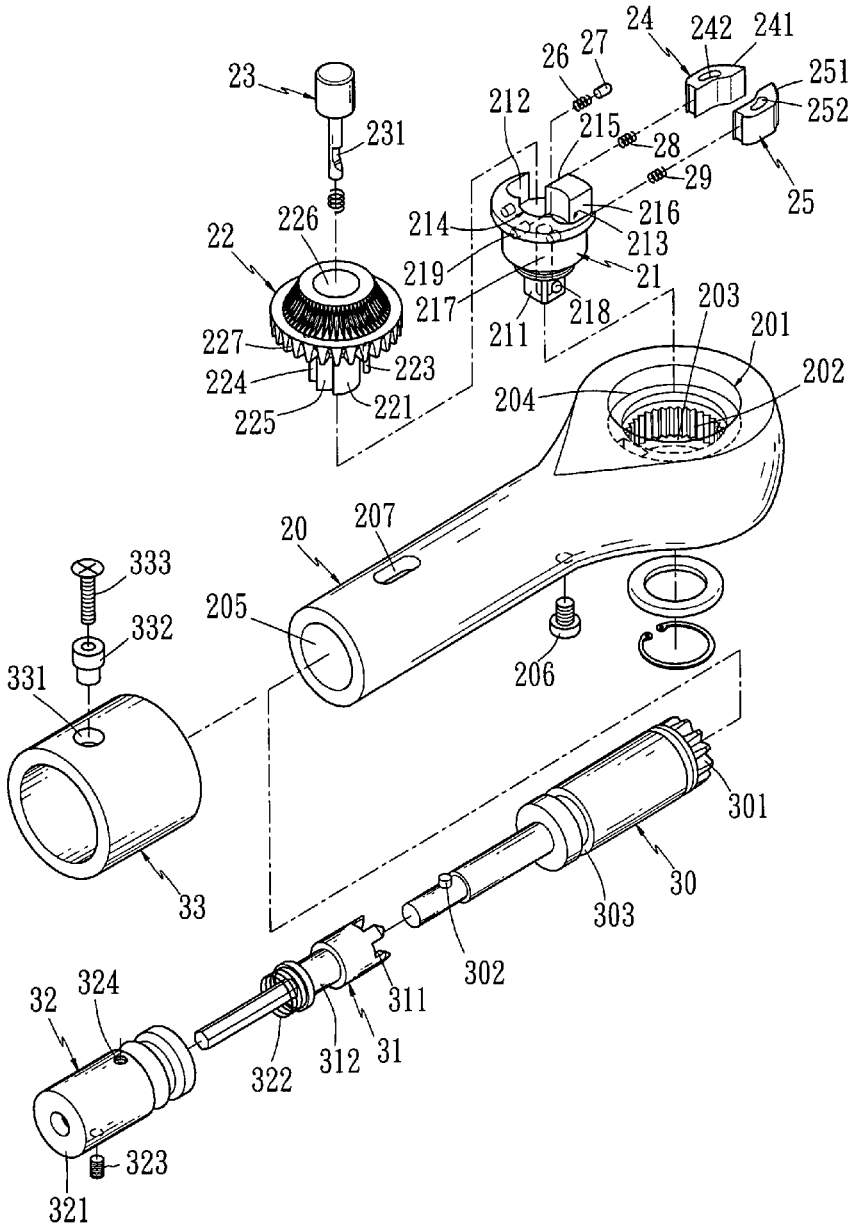
FIG. 6 is an exploded view of an interchangeably manual or automatic ratchet wrench tool of the present invention.
Figure 7:
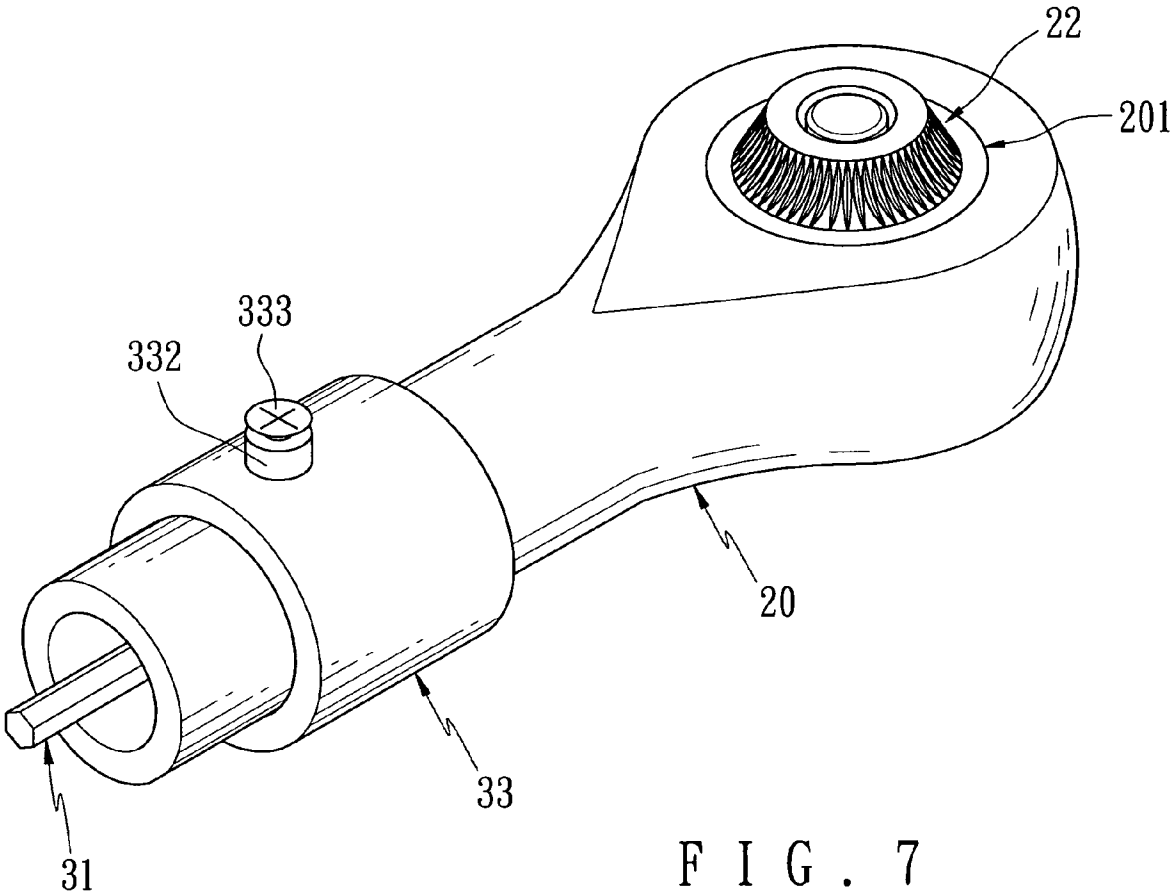
FIG. 7 is a perspective view of the interchangeably manual or automatic ratchet wrench tool of the present invention.
Figure 8:
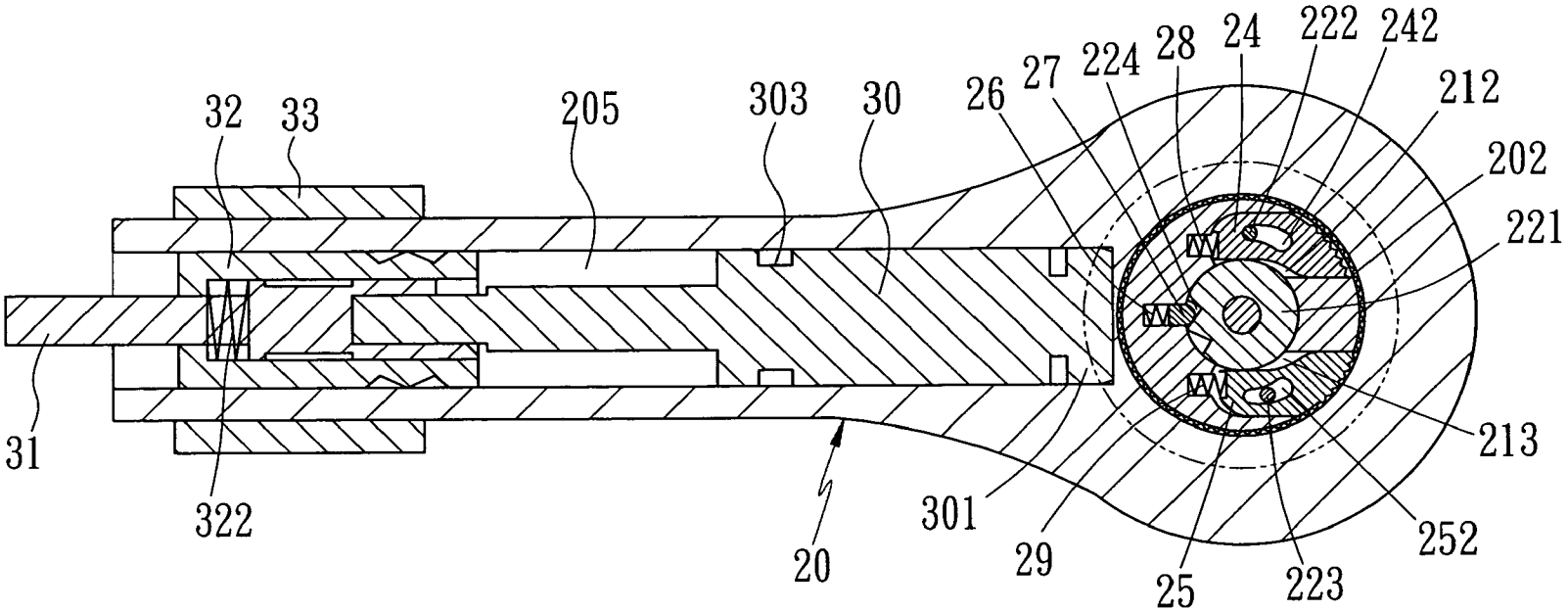
FIG. 8 is an assembly cross sectional view of the interchangeably manual or automatic ratchet wrench tool of the present invention.
Figure 9:
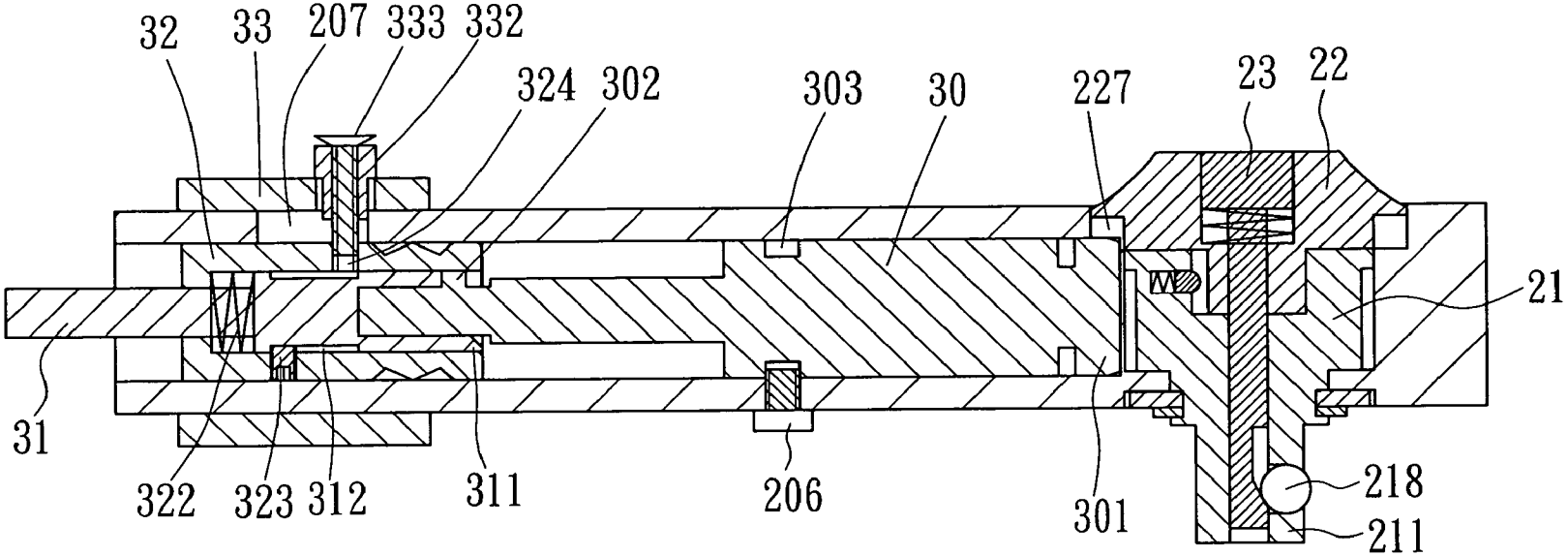
FIG. 9 is another assembly cross sectional view of the interchangeably manual or automatic ratchet wrench tool of the present invention.

Referring to FIGS. 6-9, an interchangeably manual or automatic ratchet wrench tool in accordance with the present invention comprises a handle 20 including a chamber 201 defined in the head end thereof and having an internal gear 202 provided therearound, the chamber 201 further includes a lower peripheral shoulder 203 and an upper peripheral shoulder 204 disposed around the lower and upper portions of the internal shoulder 203 respectively, and includes a cartridge 21 received therein. Besides, the handle 20 also includes a longitudinal channel 205 arranged therethrough and communicating with the chamber 201. The cartridge 21 includes an actuation bar 211 attached to the bottom thereof for insertion into the lower peripheral shoulder 203, and includes two lateral cavities 212 and 213 defined thereon and having engaging walls 215 and 216 attached to the sides thereof respectively, and includes a longitudinally large-diametered bore 214 also fixed thereon and having a small-diametered bore 217 communicating therewith relative the actuation bar 211, the small-diametered bore 217 includes a spring biased ball 218 received in the side thereof, and the large-diametered bore 214 includes an opening 219 in which a spring 26 and a detent 27 are received, the cavities 212 and 213 of the cartridge 21 are individually provided to receive two pawls 24 and 25 having a plurality of teeth affixed thereon, and by way of springs 28, 29, the pawls 24, 25 may be biased to move in the cavities 212 and 213, and the pawls 24 and 25 includes arcuate slots 242 and 252 secured therein. A direction controlling member 22 is received in the chamber 201 and includes a rotary stem 221 extended from the bottom thereof and fitted in the large-diametered bore 214, the rotary stem 221 is provided at one side thereof with two recesses 224 and 225 for being selectively biased by the detent 27, and at the predetermined positions of the direction controlling member 22 where are in response to the arcuate slots 242, 252 and adjacent to the rotary stem 221, are extendedly mounted two pins 222 and 223 respectively, which may be inserted into the arcuate slots 242 and 252 of the two pawls 24 and 25 so as to urge the pawls 24 and 25 to move outward or inward in the cavities 212 and 213 and to contact with the engaging walls 215 and 216 individually as being moved outward, such that the pawls 24, 25 may force the cartridge 21 to move. Furthermore, the direction controlling member 22 includes a peripheral gear 227 for corresponding to the longitudinal channel 205 disposed around the bottom thereof, and the rotary stem 221 includes a through hole 226 attached at the center thereof for receiving a shaft member 23 having a cut 231 formed therein for retaining the spring-biased ball 218, such that socket tools may be quickly disengaged from the actuation bar 211 (since the quick disengagement of the socket tool from the actuation bar 211 is a prior art, further remark would be omitted). A shank member 30, one end of which has a pinion 301 affixed thereon for meshing with a peripheral gear 227 of the direction controlling member 22, and another end of which has a locking pillar 302 secured thereon, is fitted in the longitudinal channel 205, and includes a peripheral groove 303 arranged therearound for preventing the shank member 30 from removing from the longitudinal channel 205 and for engaging the shank member 30 with the peripheral gear 227, after a confining peg 206 screwingly fastened into the handle 20. In addition, a stud member 31, one end of which has a selector mechanism for couplingly driving the shank member 30, another end of which extends out of the handle 20, is fitted in the longitudinal channel 205. The selector mechanism includes a fitting cylinder 32 having an arresting rim 321 fixed on the bottom thereof and may receive a spring 322 and the stud member 31 therein. The stud member 31 has a toothed engaging block 311 formed on one end thereof and may compress against the spring 322. To confine the stud member 31 in the fitting cylinder 32, a peripheral groove 312 is attached around the stud member 31 for moving the stud member 31 outward and inward in the fitting cylinder 32, after a confining peg 323 being fastened into the fitting cylinder 32, and a mounting block 33 is fitted onto the handle 20 and includes a fastening orifice 331 in response to an aperture 207 formed on the handle 20, the fastening orifice 331 contains a stepped bush 332 fitted therein. As pushing the mounting block 33 to move forward along the aperture 207, by screwing a bolt 333 with a threaded opening 324 of the fitting cylinder 32, the fitting cylinder 32 and the stud member 31 may be simultaneously urged to move forward for engagement with the locking pillar 302 of the shank member 30, thereby engagably driving the shank member 30. If pushing the mounting block 33 to move backward along the aperture 207, the fitting cylinder 32 and the stud member 31 may be simultaneously urged to move rearward for removing from the locking pillar 302 of the shank member 30, thereby disengaging from the driven shank member 30 to interchange different driving tools.

Figure 10:
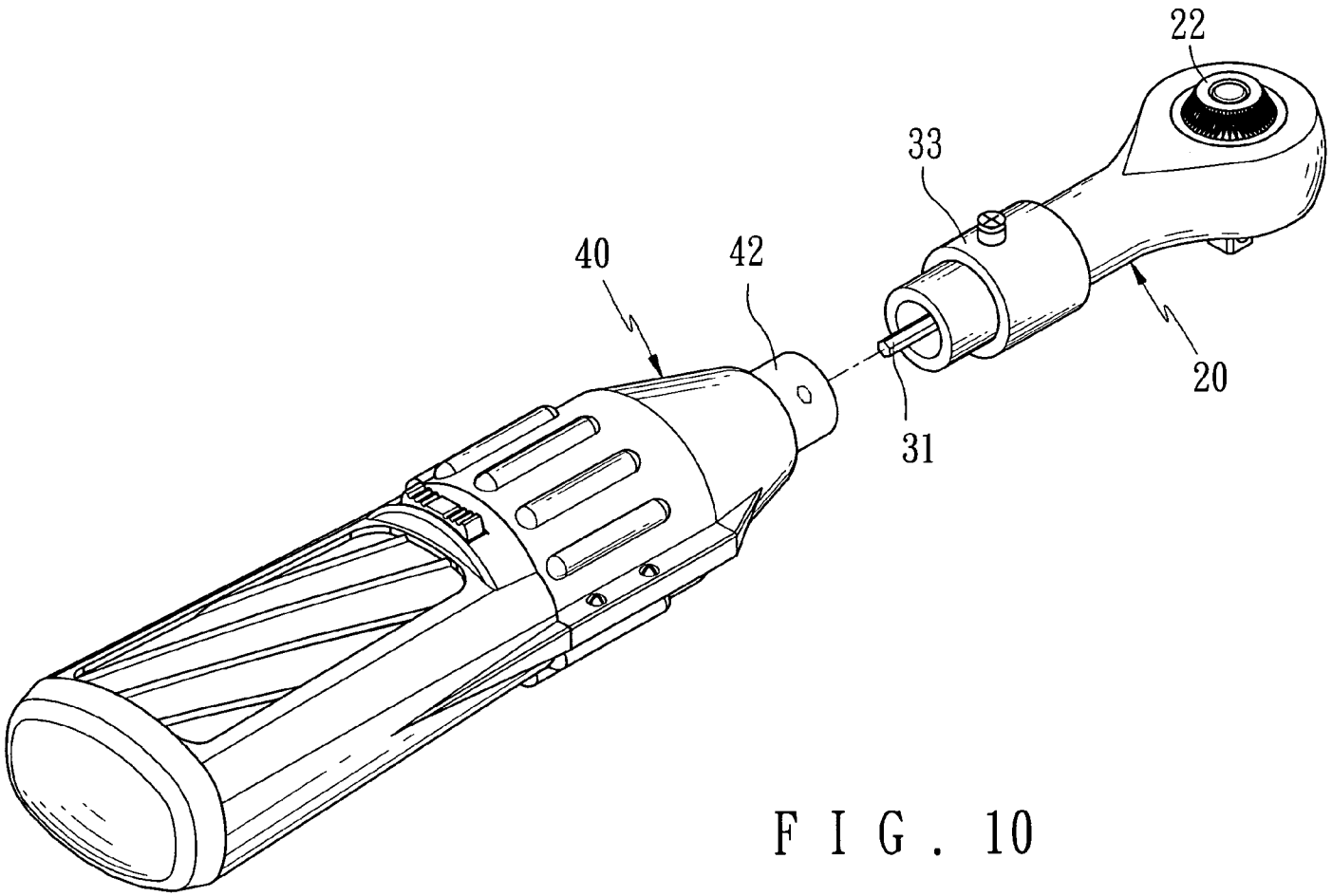
FIG. 10 is an exploded view showing an electric operation mode of the present invention.
Figure 11:
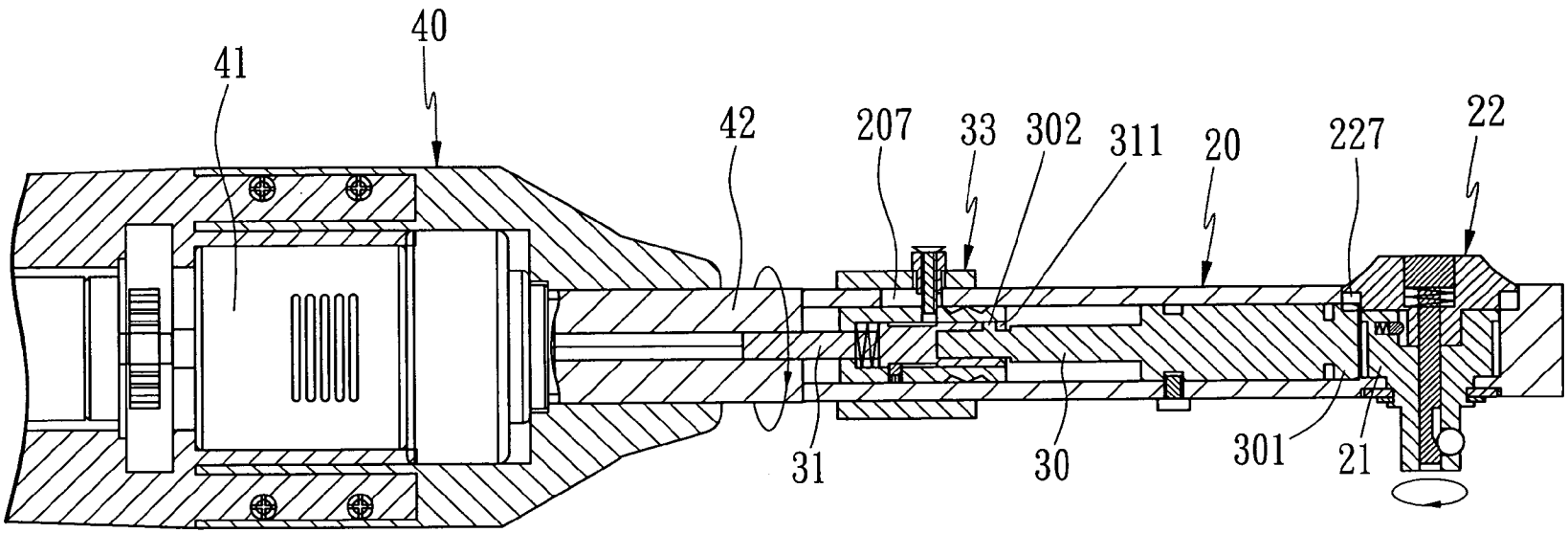
FIG. 11 is an assembly cross sectional view showing the electric operation mode of the present invention.

In the electric operation mode, with reference to FIGS. 10 and 11, an electric hand grip 40 having a motor 41 placed therein is coupled to the rear end of the handle 20, and the stud member 31 is fittingly joined to an output spindle 42 of the motor 41 for transmitting the output power of the output spindle 42 to the stud member 31, and since the mounting block 33 is located at the front end of the aperture 207, the engaging block 311 of the stud member 31 engages with the locking pillar 302 of the shank member 30 so as to drive the shank member 30, thereby urging the cartridge 21 to rotate.

Figure 12:
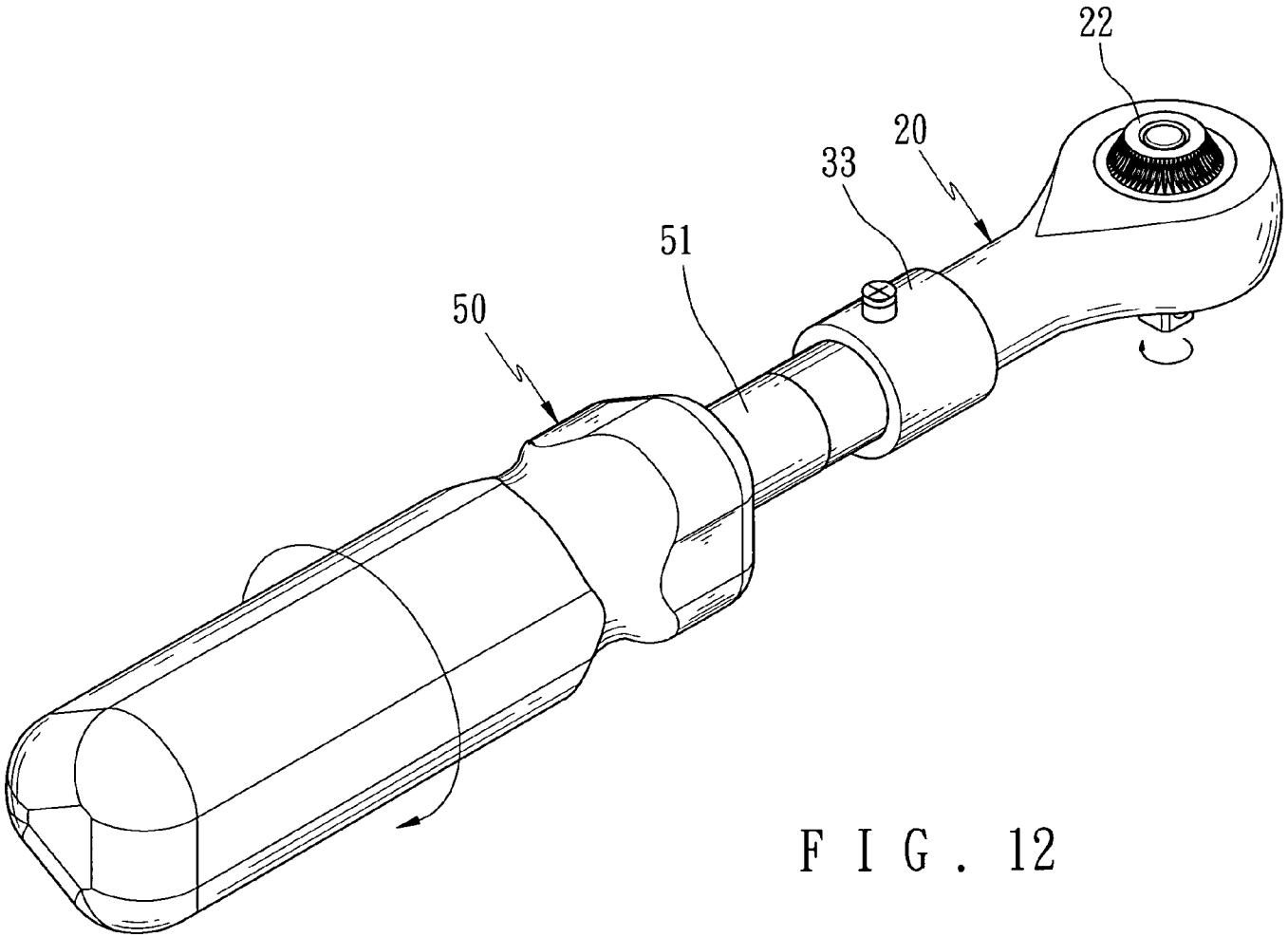
FIG. 12 is a perspective view showing a first manual operation mode of the present invention.
Figure 13:
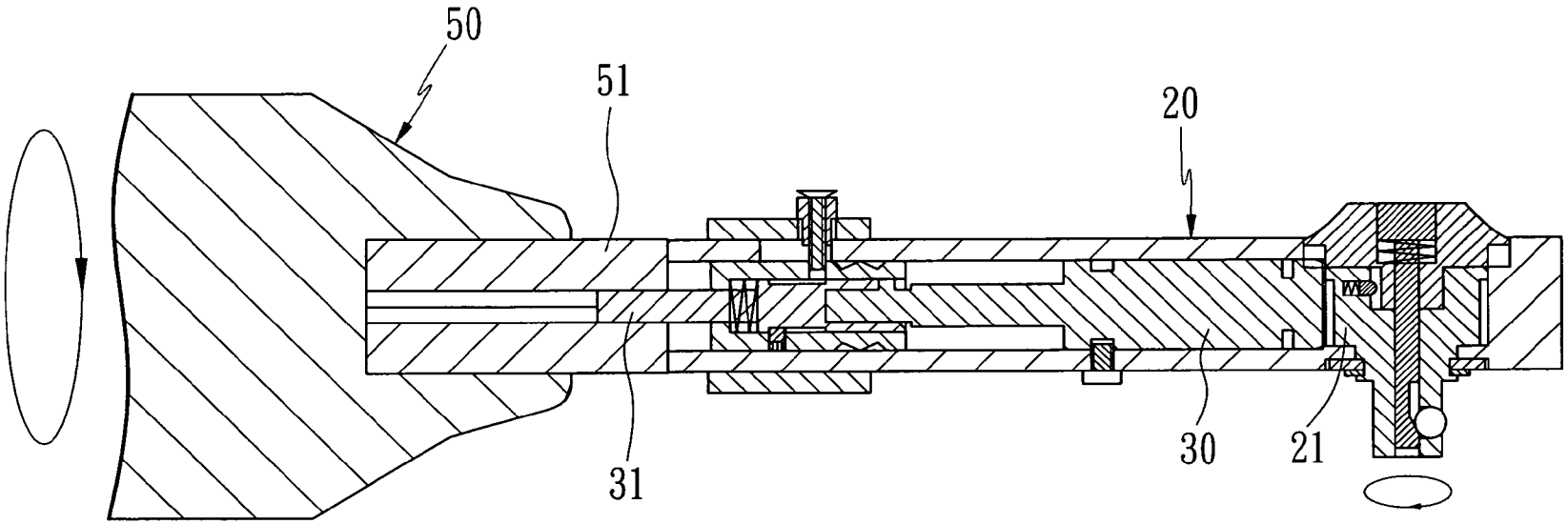
FIG. 13 is a cross sectional view showing the first manual operation mode of the present invention.

In a first manual operation mode, referring to FIGS. 12 and 13, an adaptor element 51 of a hand grip 50 is fittingly connected to the stud member 31 of the handle 20, by manually rotating the hand grip 50, it urges the adaptor element 51 to turn, hence the stud member 31, the shank member 30 and the cartridge 21 may be in turn driven to turn.

Figure 14:
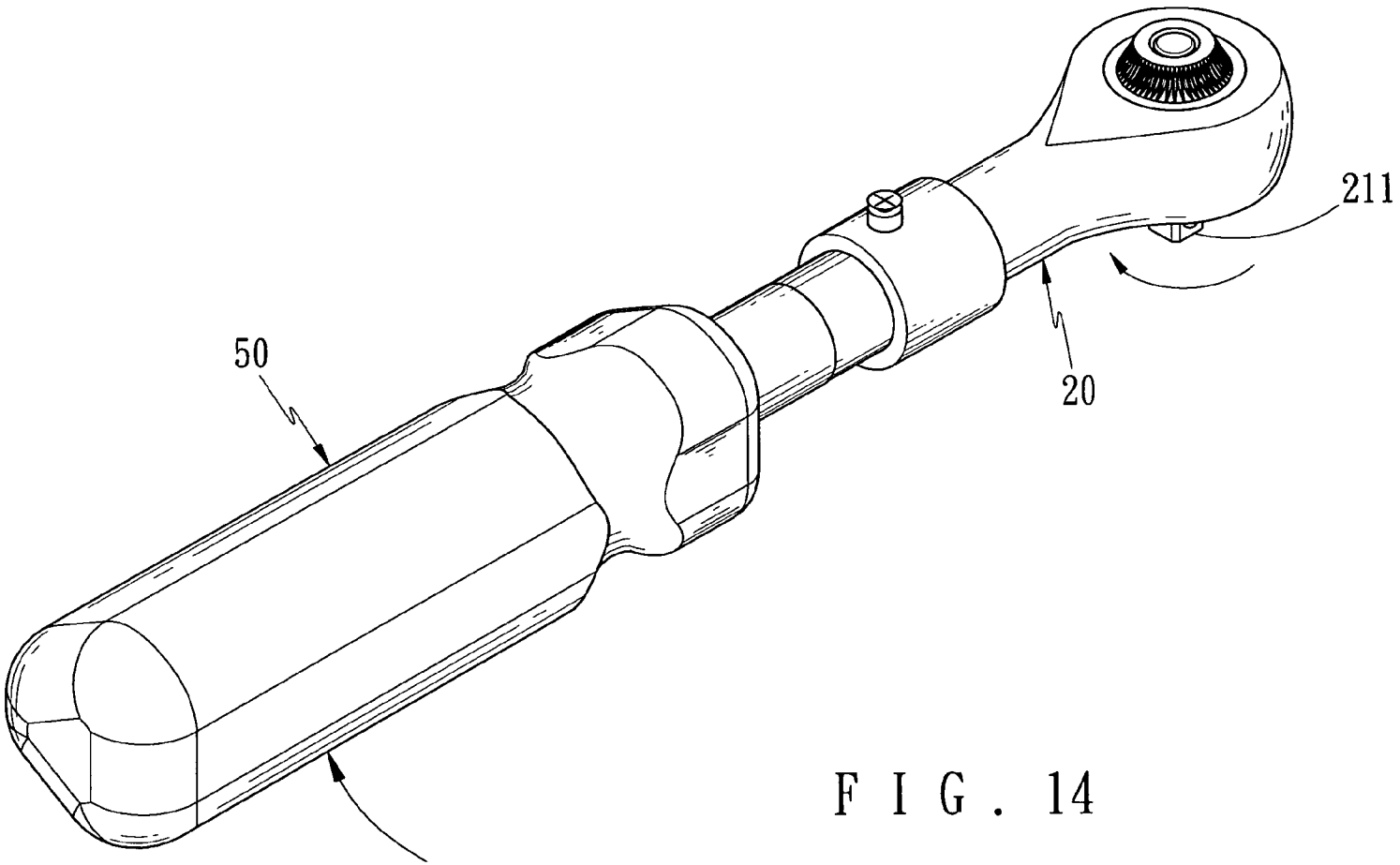
FIG. 14 is a perspective view showing a second manual operation mode of the present invention.

As shown in FIG. 14, in a second manual operation mode, the actuation bar 211 may be used as a canter, and the hand grip 50 is pivotally rotated as a ratchet wrench, hence such a manual operation mode may be provided to loosen workpieces in the beginning or to fasten workpieces in the ending, as the output torque of the electric wrench is limited.

Figure 15:
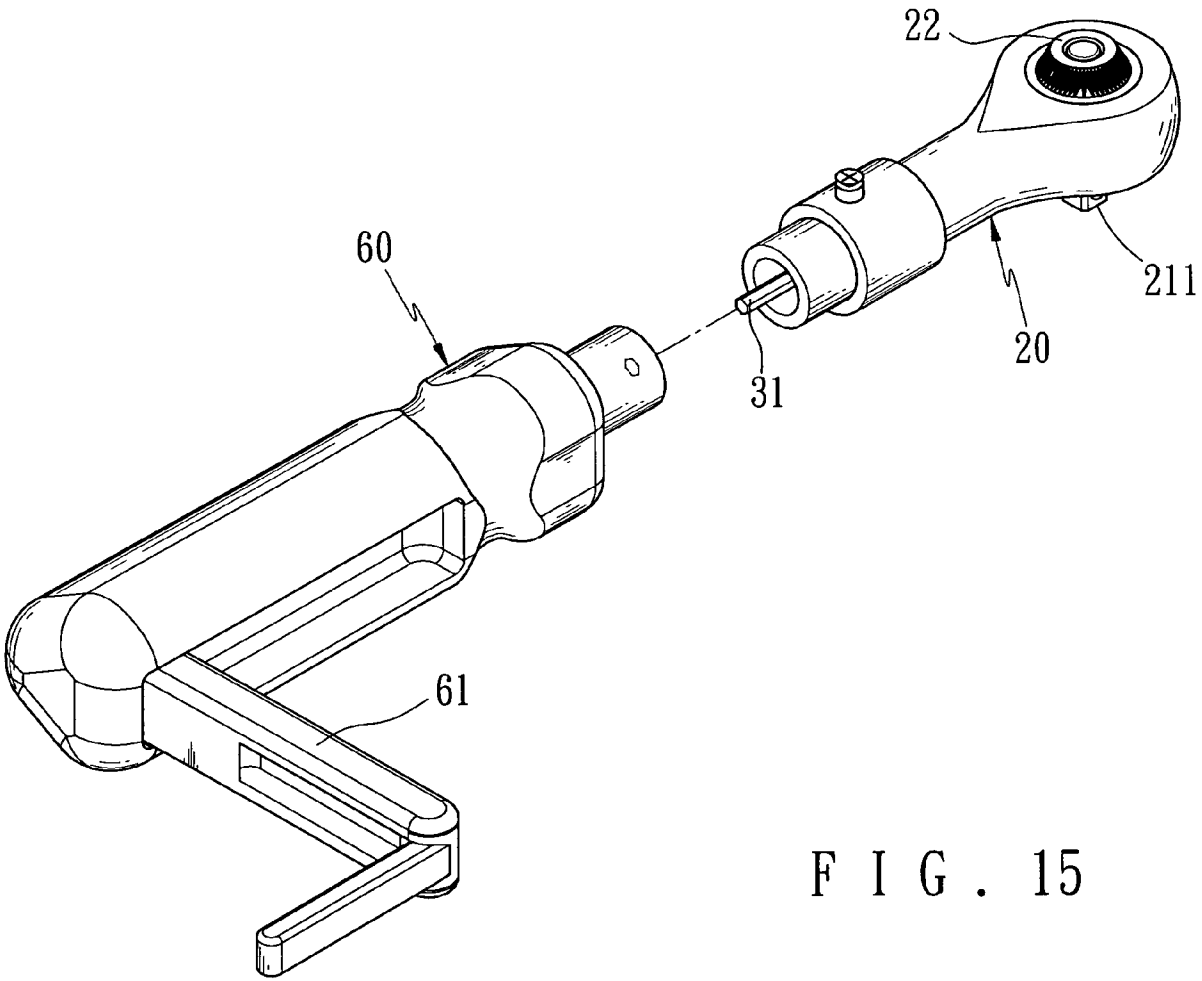
FIG. 15 is an exploded view showing a further manual operation mode of the present invention.
Figure 16:
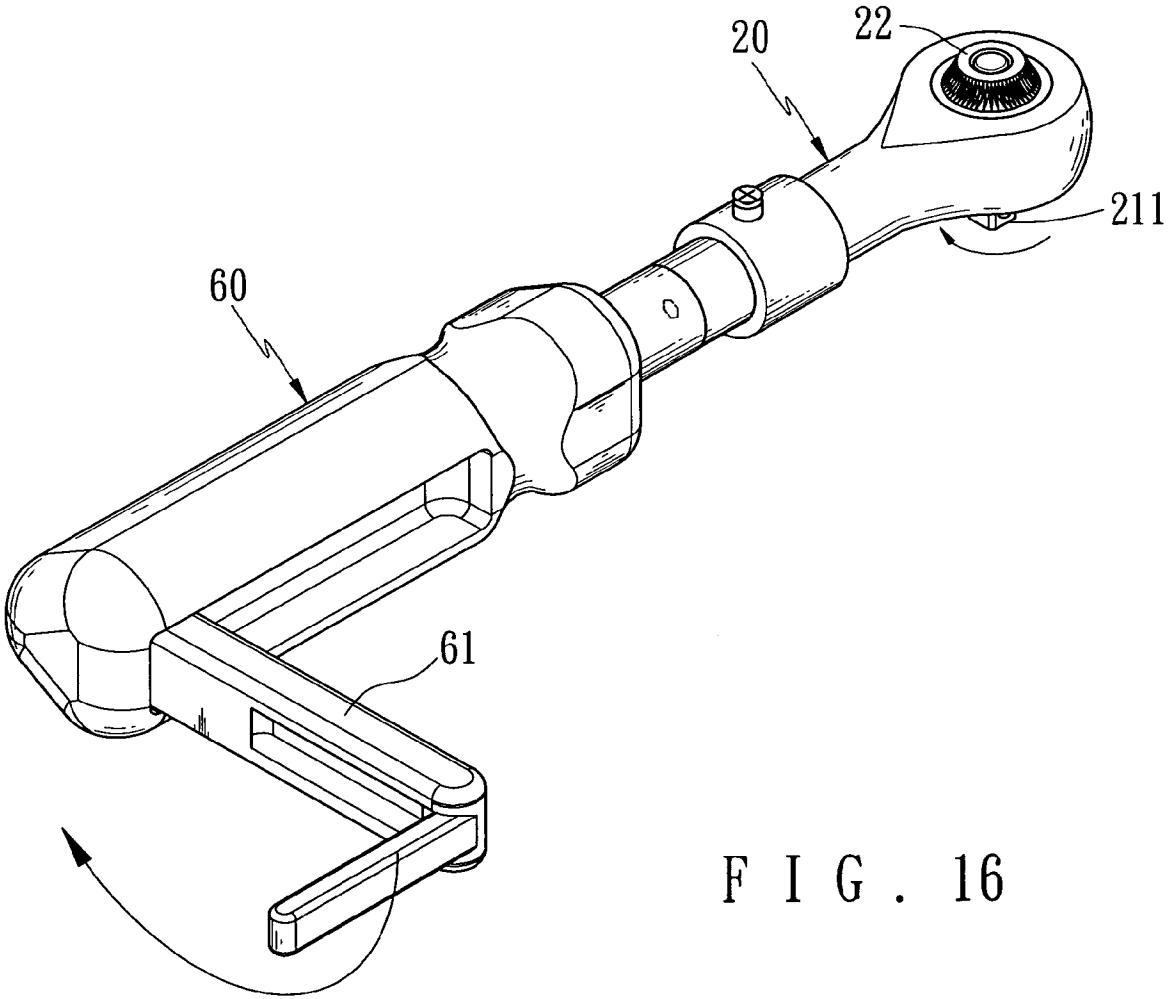
FIG. 16 is an operational view showing the further manual operation mode of the present invention.

As illustrating to FIGS. 15 and 16, in a further manual operation mode, the stud member 31 is joined to a hand grip 60 having a crank 61 received therein and expanded therefrom, and the crank 61 may turn the hand grip 60 to urge the rotation of the stud member 31, accordingly the actuation bar 211 of the cartridge 21 may be turned.

Figure 17:
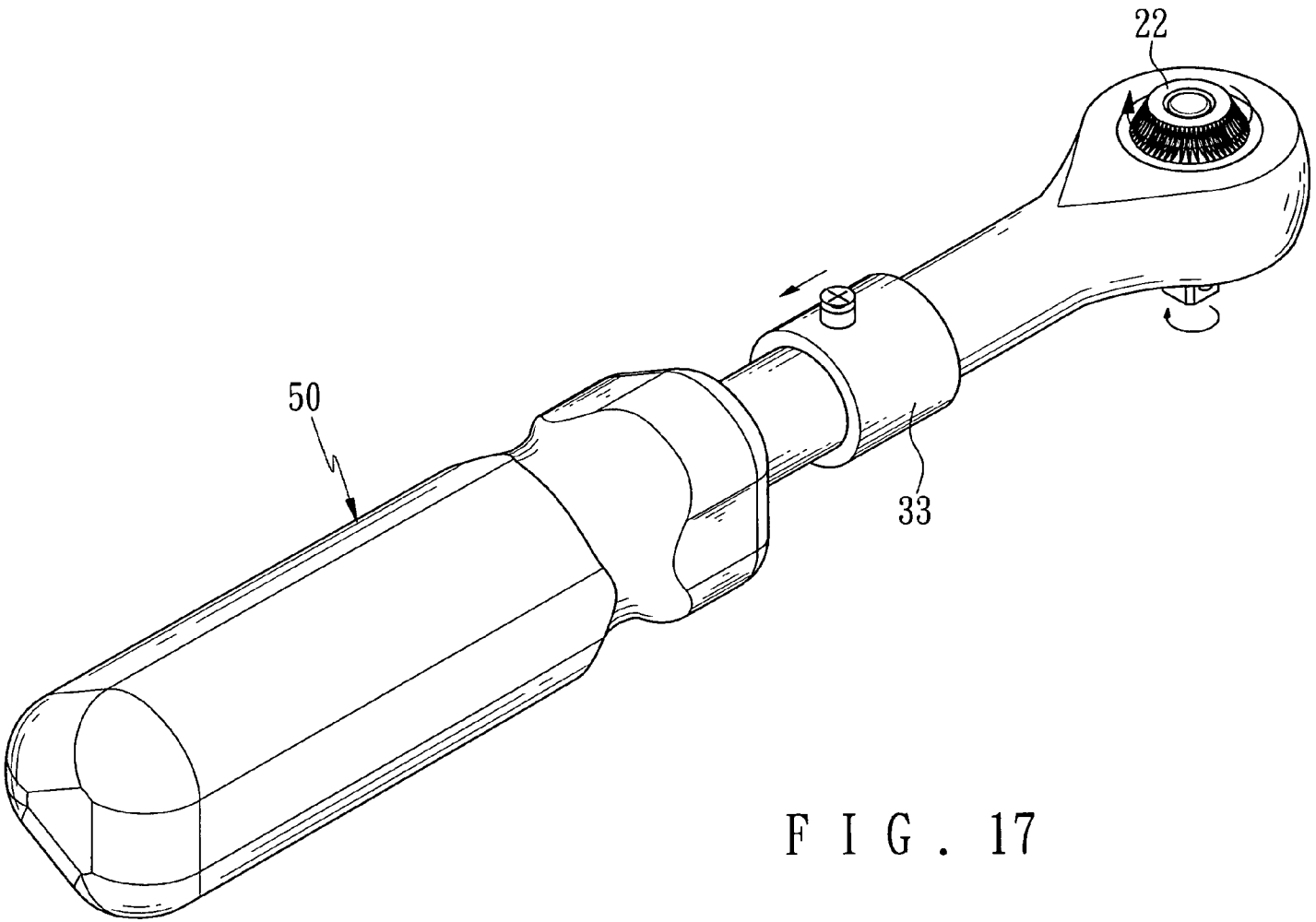
FIG. 17 is a perspective view showing another manual operation mode of the present invention.
Figure 18:
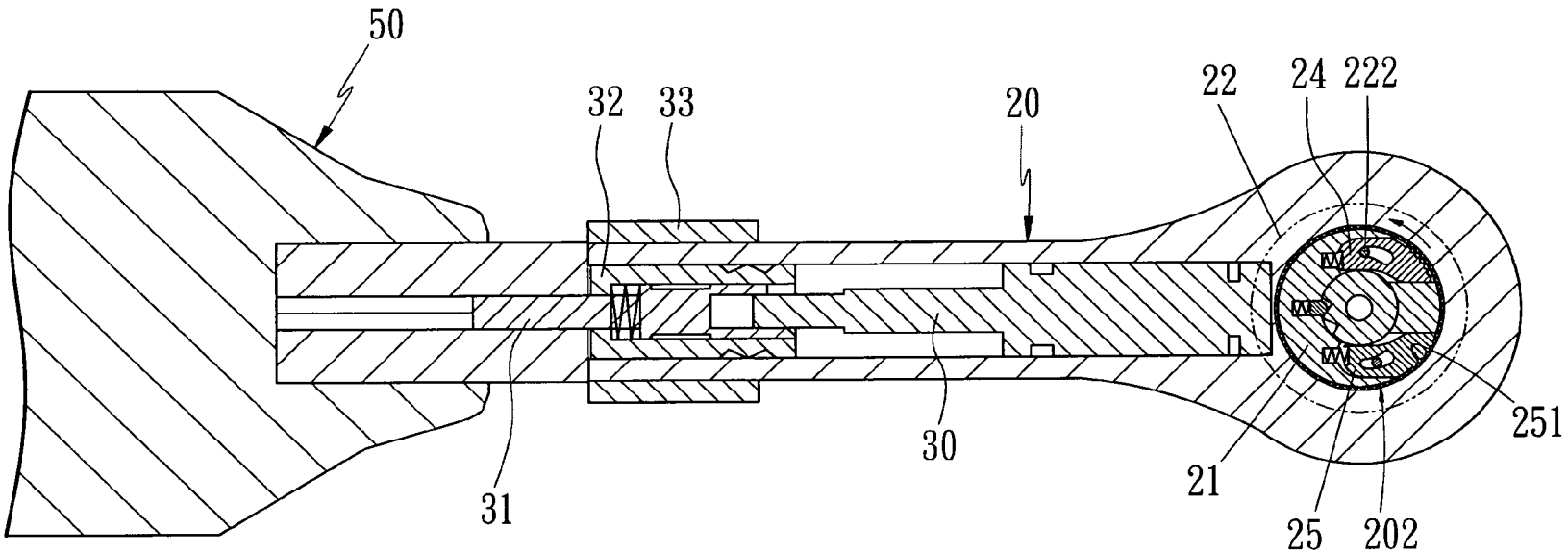
FIG. 18 is a cross sectional view showing another manual operation mode of the present invention.
Figure 19:
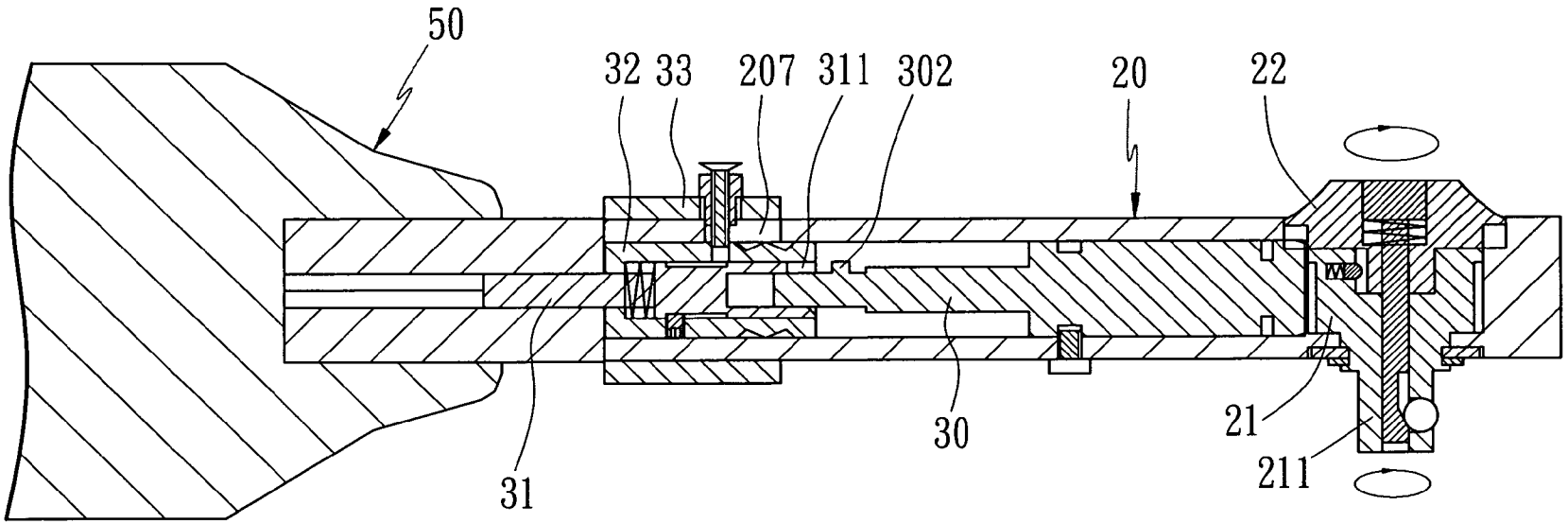
FIG. 19 is another cross sectional view showing another manual operation mode of the present invention.

In another manual operation mode, referring to FIGS. 17-19, the direction controlling member 22 is turned by hand so as to loosen workpieces. For example, if the direction controlling member 22 is rotated counterclockwise, the pin 222 is in abutment against the pawl 24 to move inward, thereby as the direction controlling member 22 turning, by using the pawl 24 to push the cartridge 21, the direction controlling member 22 may drive the cartridge 21 to simultaneously rotate in a counterclockwise direction, and the teeth 251 of the pawl 25 are pressed by the peripheral gear 202 of the handle 20 to move inward and pass across the peripheral gear 202 tooth by tooth, thus enabling to rotate the direction controlling member 22 by hand. To avoid driving the hand grip 50 in an opposite direction, while the cartridge 21, the shank member 30 and the stud member 31 being urged, the selector mechanism has to be adjusted. In other words, as pushing the mounting block 33 to move backward along the aperture 207, the fitting cylinder 32 and the stud member 31 may be urged to move backward so as to release the engagement with the locking pillar 302 of the shank member 30, hence the shank member 30 may not urge the rotation of the stud member 31, and the hand grip 50 may not be rotated with the rotation of the direction controlling member 22.

The invention is not limited to the above embodiment but various modifications thereof may be made. It will be understood by those skilled in the art that various changes in form and detail may made without departing from the scope and spirit of the present invention.

What is claimed is:

1. An interchangeably manual or automatic ratchet wrench tool comprising: a handle including a chamber defined in the head end thereof and having an internal gear provided therearound, and including a longitudinal channel arranged therethrough and communicating with said chamber;

a cartridge received in said chamber of said handle and including an actuation bar attached to the bottom thereof, and including two lateral cavities and a longitudinally large-diametered bore all fixed thereon;

two pawls received in said two lateral cavities of said cartridge and biased against by springs respectively, and including a plurality of teeth affixed thereon for engagement with said internal gear of said handle, and including arcuate slots secured therein individually;

a direction controlling member received in said chamber of said handle and including a rotary stem extended from the bottom thereof and fitted in said large-diametered bore, at the predetermined positions of said direction controlling member where are in response to said arcuate slots of said pawls and adjacent to said rotary stem being extendedly mounted two pins respectively, which may be inserted into said arcuate slots, besides, said direction controlling member further including a peripheral gear disposed around the bottom thereof;

a stud member and a shank member both fitted through and in said longitudinal channel of said handle, a first end of said stud member having an engaging block and a second end thereof extending out of said longitudinal channel of said handle, a first end of said shank member having a pinion for engagement with said peripheral gear of said direction controlling member and a second end portion thereof engaging said engagement block of said stud member;

further comprising a selector mechanism for couplingly driving said shank member by said stud member, said selector mechanism including a fitting cylinder having an arresting rim fixed on the bottom thereof for receiving a spring and said stud member within said fitting cylinder, a peripheral groove formed around said stud member, a confining peg fastened into said fitting cylinder; and a locking pillar fixed to said second end portion of said shank member;

wherein said stud member is limitedly moveable outward and inward in said fitting cylinder, such that said engaging block of said stud member may clutch with said locking pillar of said shank member.

2. The interchangeably manual or automatic ratchet wrench tool as claimed in claim 1, wherein said selector mechanism further comprises an aperture formed on said handle, a mounting block fitted onto said handle and including a fastening orifice in response to said aperture affixed thereon, by screwing a bolt with a threaded opening of said fitting cylinder, said fitting cylinder may be pushed along said aperture to move forward and backward so as to urge said engaging block of said stud member to clutch with said locking pillar of said shank member.

3. The interchangeably manual or automatic ratchet wrench tool as claimed in claim 1 further comprising an electric hand grip having a motor placed therein coupled to the rear end of said handle, and said stud member fittingly joined to an output spindle of said motor so as to obtain an electric operation.

4. The interchangeably manual or automatic ratchet wrench tool as claimed in claim 1 further comprising a hand grip, having an adaptor element coupled thereto, fittingly connected to said stud member of said handle, so as to obtain a manual operation.

* * * * *